US005584546A

United States Patent [19]

Gurin et al.

[11] Patent Number: 5,584,546

[45] Date of Patent: Dec. 17, 1996

[54] TRANSPORTABLE OFFICE WORK STATION

[76] Inventors: Robert N. Gurin; Cynthia S. Gurin, both of P.O. Box 912, Summerland Key, Fla. 33042

[21] Appl. No.: 444,151

[22] Filed: May 18, 1995

[51] Int. Cl.[6] ..... A47B 53/00

[52] U.S. Cl. ..... 312/200; 312/223.3; 312/198; 312/199; 312/351.11; 16/19

[58] Field of Search ..... 16/19; 312/223.3, 312/198, 199, 200, 351.11, 319.5, 319.6

[56] References Cited

U.S. PATENT DOCUMENTS

| | | | |
|---|---|---|---|
| 341,100 | 5/1886 | Fletcher | 312/200 |
| 3,479,103 | 11/1969 | Geier | 312/198 |
| 4,712,842 | 12/1987 | Price et al. | 312/223.3 |
| 4,725,106 | 2/1988 | Shields et al. | 312/223.3 |
| 4,845,804 | 7/1989 | Garrett | 16/19 |
| 4,852,500 | 8/1989 | Ryburg et al. | 312/223.3 X |
| 4,861,121 | 8/1989 | Gotz | 312/223.3 |
| 5,347,680 | 9/1994 | Rippe | 16/19 |
| 5,386,329 | 1/1995 | Ikegawa | 360/94 |
| 5,403,082 | 4/1995 | Kramer | 312/223.3 X |
| 5,419,414 | 5/1995 | Sakita | 187/391 |
| 5,437,235 | 8/1995 | Randolph | 312/223.3 X |

*Primary Examiner*—Peter M. Cuomo
*Assistant Examiner*—Stephen Vu
*Attorney, Agent, or Firm*—Vernon C. Maine

[57] ABSTRACT

A transportable office work station enclosure with door and retractable casters, adequate interior room to stow a chair when closed, a desktop that is a level, full size, load bearing, wheelchair-accessible work surface but incorporates a front section that is alternatively vertically adjustable for use with a keyboard, overhead storage for major computer components with an elevator for raising and lowering them to user height, internal plug-in outlets prewired to external connectors for phone and power hookups, and interior cabinets for storage.

10 Claims, 15 Drawing Sheets

TRANSPORTABLE OFFICE WORK STATION

BACKGROUND OF THE INVENTION

1. Technical Field of the Invention

This invention most generally relates to transportable office work stations, desks and cabinets.

More particularly, this invention relates to transportable office work stations which are fully closable and equipped with retractable means for moving or repositioning, have lifting means to stow computer system components in overhead space to free desktop surface for other work, and a desktop that alternatively provides a full size, load bearing, wheelchair accessible work surface or a readily adjustable means to support a computer keyboard at other than actual desktop height.

2. Background Art

Office supply catalogs and stores offer numerous variations of simple and elaborate designs for integrated office work stations in the form of modular offices configurable from components, and desks and cabinets variously designed to accommodate computers and other office accessories in a compact office work center.

These designs typically incorporate work surfaces and storage areas. Fully enclosable variations are known, as are caster mounted examples. Sliding, hinged and rotating keyboard supports that stow underneath a desktop, fold up or down against a sidewall, or into a slot in the desk or cabinet are known.

The problem unresolved by these designs is the lack of total integration of useful features including compact size, full enclosability with room for a chair, transportability and stationary positioning, prewired circuitry to permit plug-in installation of common office equipment and telephone within the enclosure as well as simple external connections to power and telephone lines, means for stowing the computer monitor overhead to free desk area for other work, and means for making a portion of the desktop adjustable for keyboard height without compromising the alternative availability of a full size, load bearing, wheelchair accessible work surface when needed.

SUMMARY OF THE INVENTION

A primary object of the invention is to create a transportable office work station that integrates important features into a more easily installed, space-efficient and ergonomic work station than has been previously available.

An object of the invention is to combine maximum available desktop work space with computer capability. To this end, overhead storage is provided for the major components of a computer so that the desktop can be cleared, with means for raising and lowering to near desktop height for normal use.

Another object is to combine the transportability of casters with the installed stability of fixed support. To this end, the invention is equipped with a retractable caster capability.

Yet another object is to maintain the capability of a full size, load bearing desktop that is wheelchair accessible, but also provide means to vertically adjust a front section of the desktop for keyboard support. To this end, a base section provides direct support to a closely fitting, level front section, and alternatively provides for vertical adjustment of the front section for use with a keyboard when a computer is being used, without extensive structure under the desktop.

Still yet another object of the invention is to provide simple means to install telephone and powered office equipment within the work station, while maintaining ease of external connections to telephone lines and power sources. To this end, the invention may be prewired to provide internal telephone and power plug-in outlets and external connectors for phone and power hookups.

Still other objects and advantages of the present invention will become readily apparent to those skilled in this art from the following detailed description, wherein I have shown and described only a preferred embodiment of the invention, simply by way of illustration of the best mode contemplated by me on carrying out my invention. As will be realized, the invention is capable of other and different embodiments, and its several details are capable of modifications in various obvious respects, all without departing from the invention.

The objects and advantages of the invention may be further realized and attained by means of the instrumentalities and combinations particularly pointed out in the appended claims. Accordingly, the drawing and description are to be regarded as illustrative in nature, and not as restrictive.

FIG, 4 is a front perspective of the base section layers showing the support means for a front section.

Figure 5:
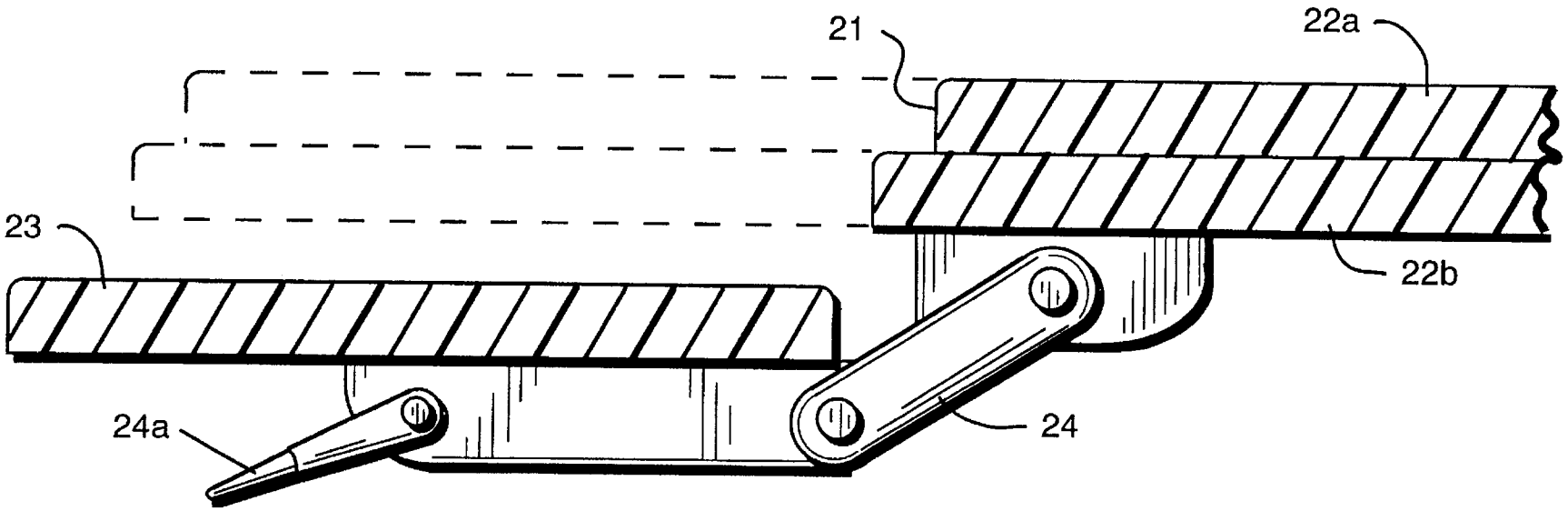

FIG. 5 is a cross section side view of the desktop showing the front section adjusted vertically lower to accommodate a keyboard.

Figure 6:
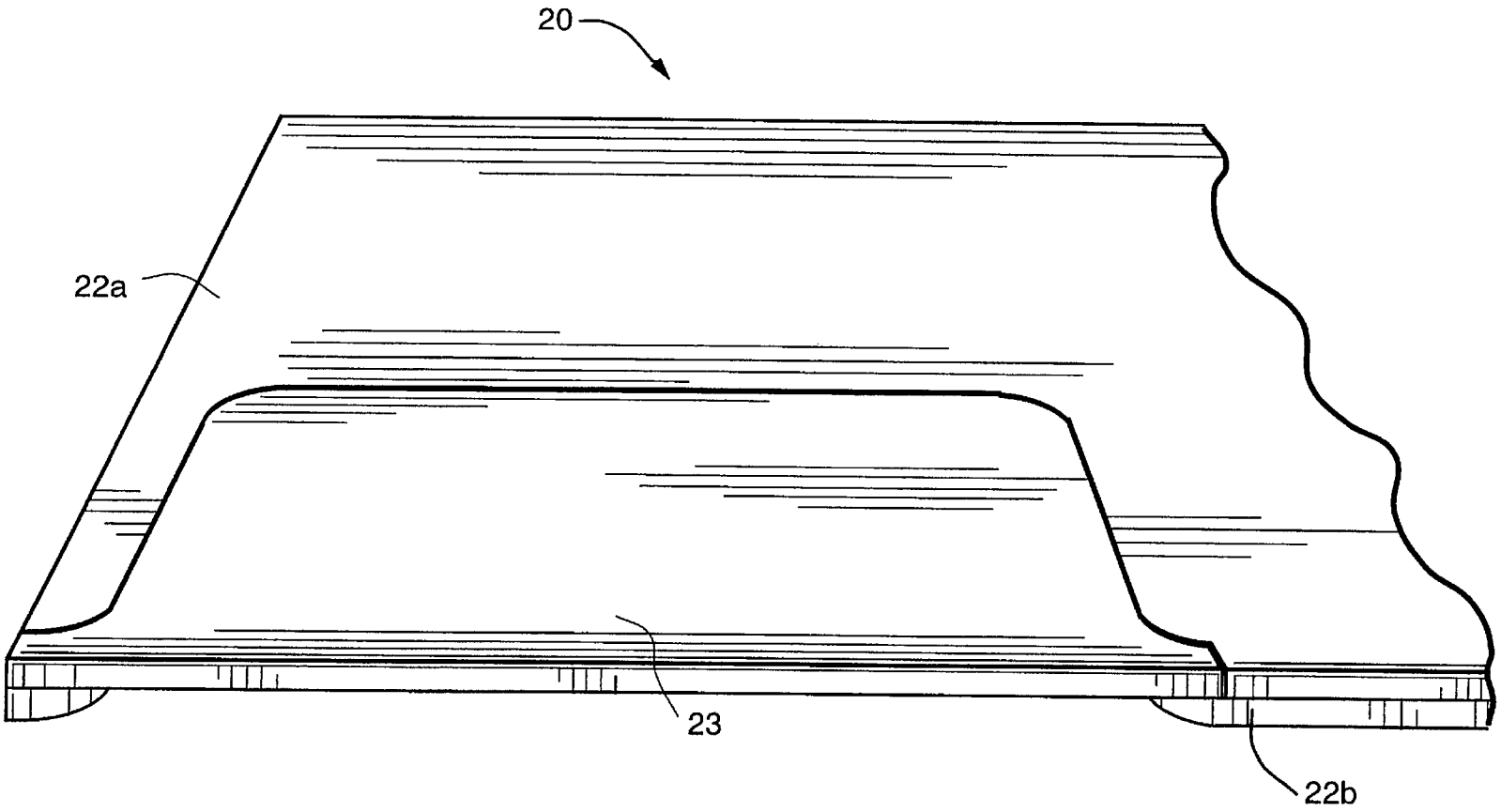

FIG. 6 is a front perspective of the desktop showing the front section adjusted level and inserted into the cutout of the base section.

Figure 7:
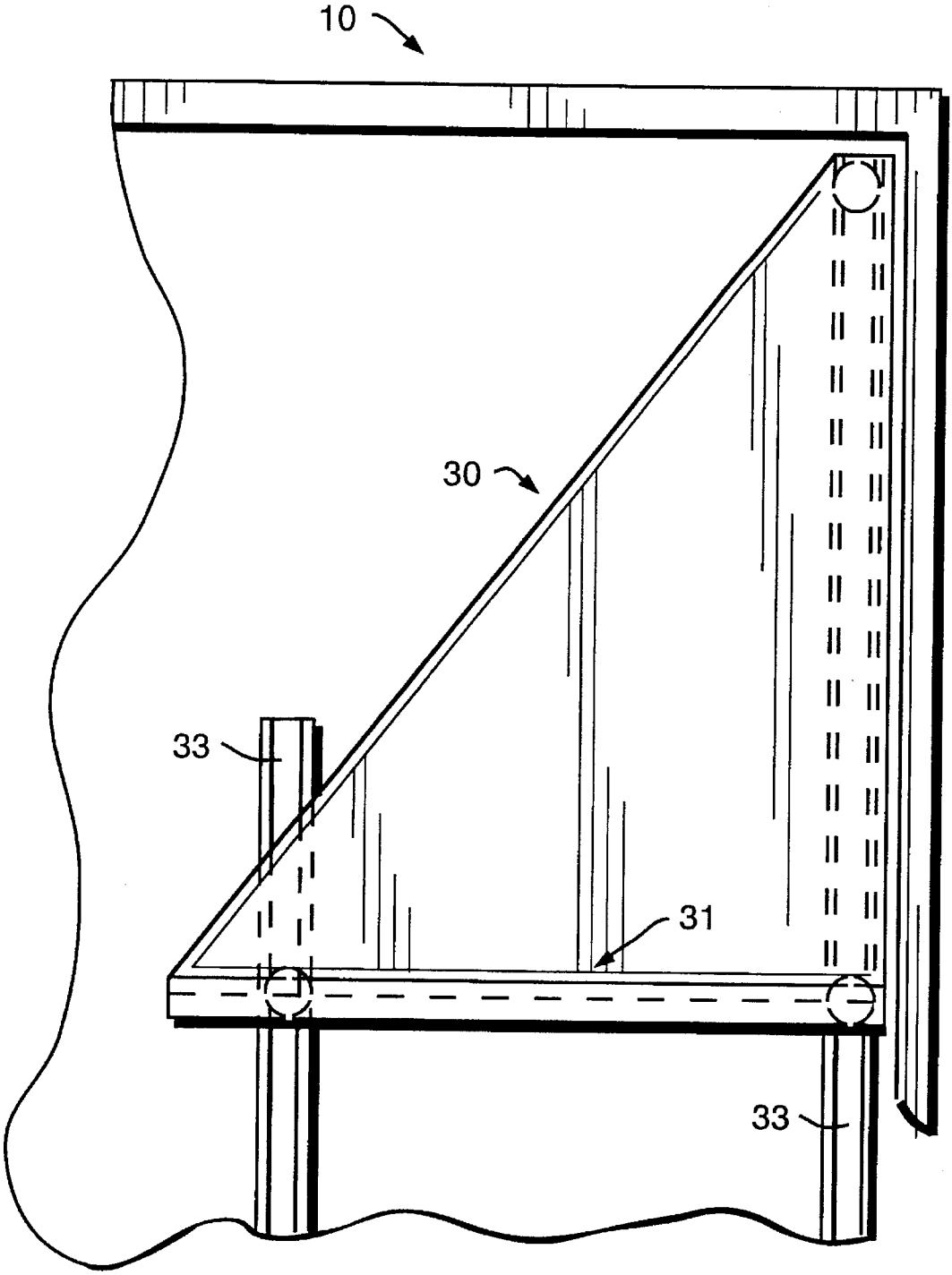

FIG. 7 is a cross section side view of the monitor elevator.

Figure 8:
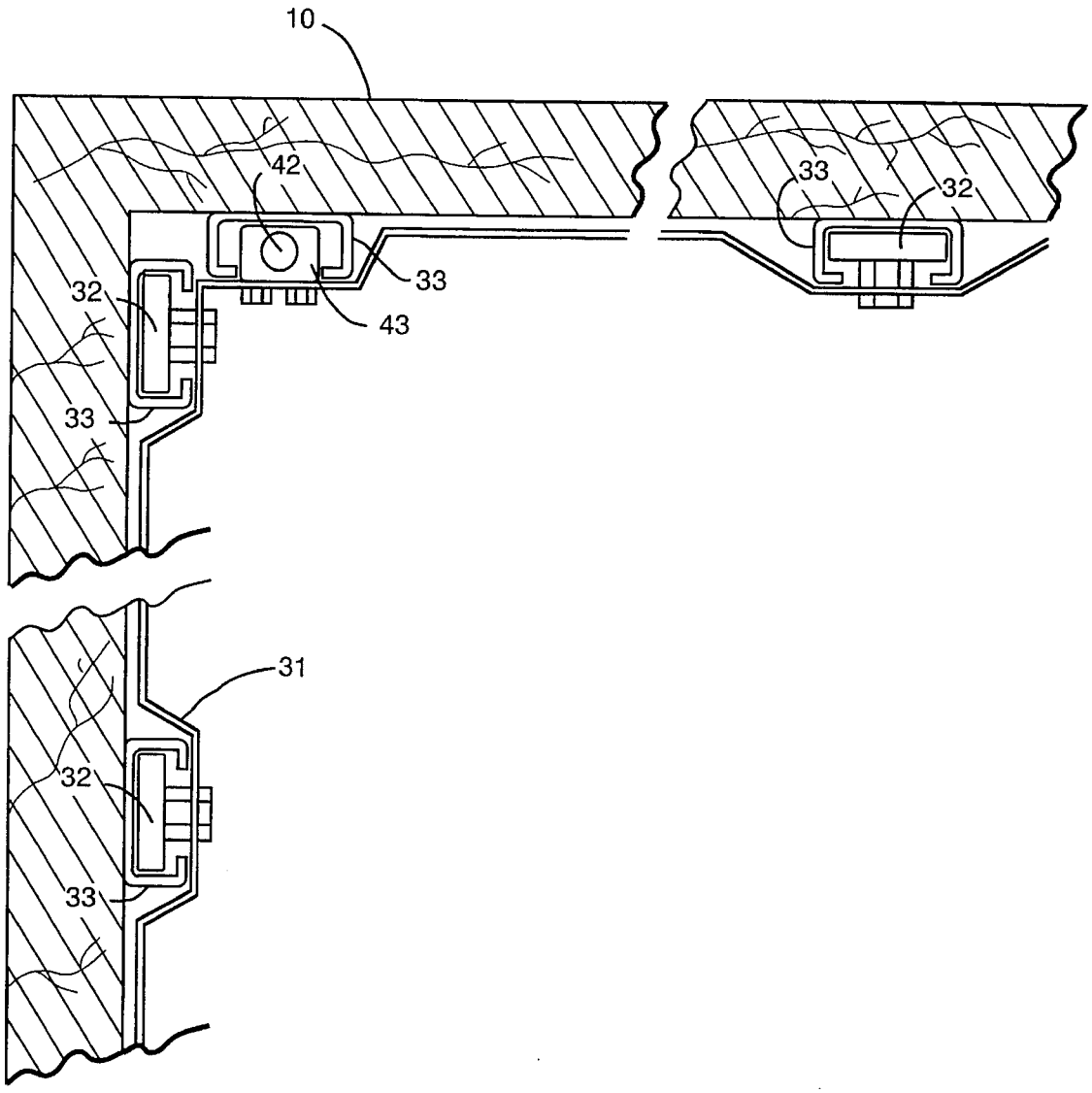

FIG. 8 is a cross section top view of the monitor elevator and tracks.

Figure 9:
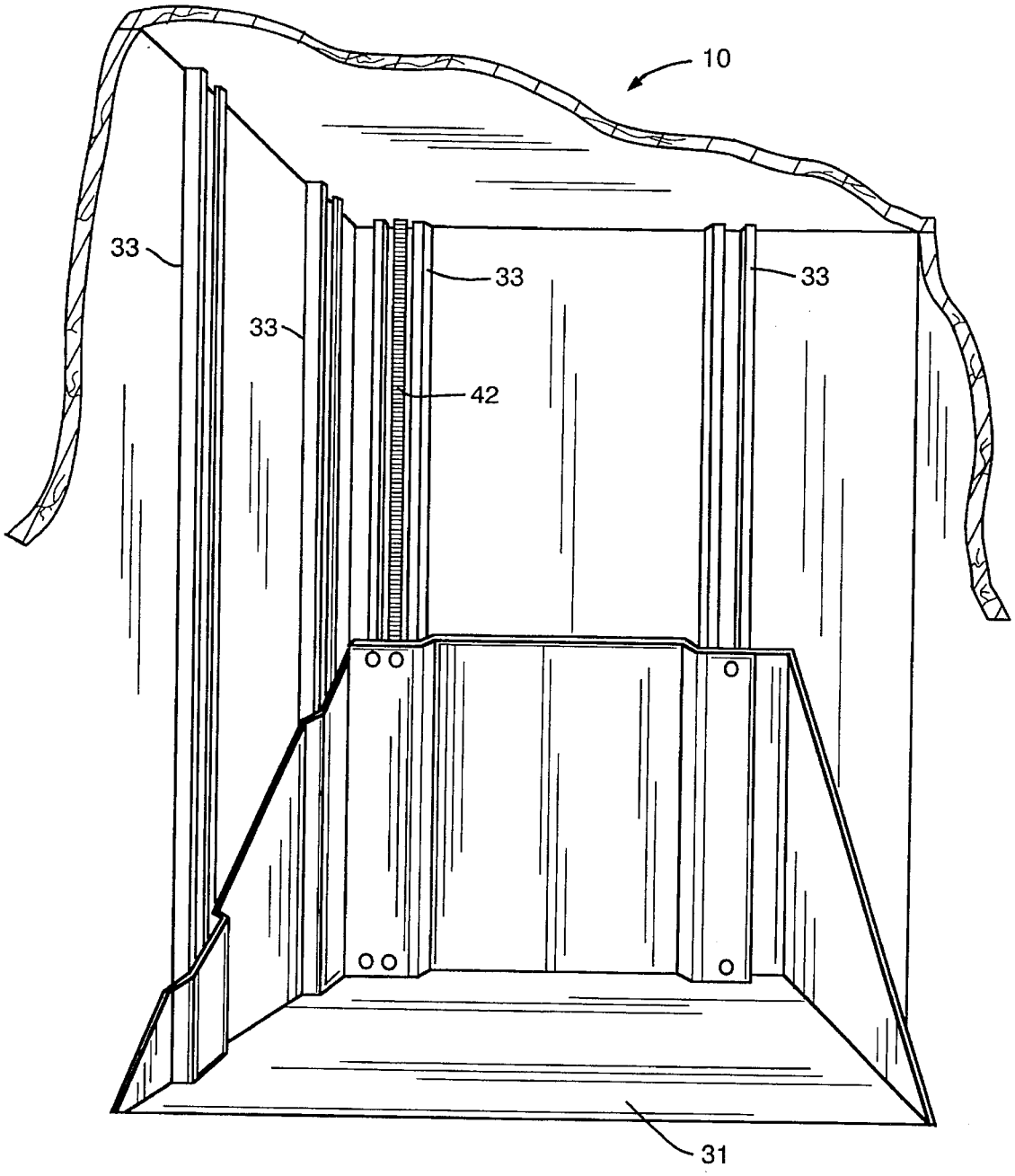

FIG. 9 is a front perspective of the monitor elevator and tracks.

Figure 10:
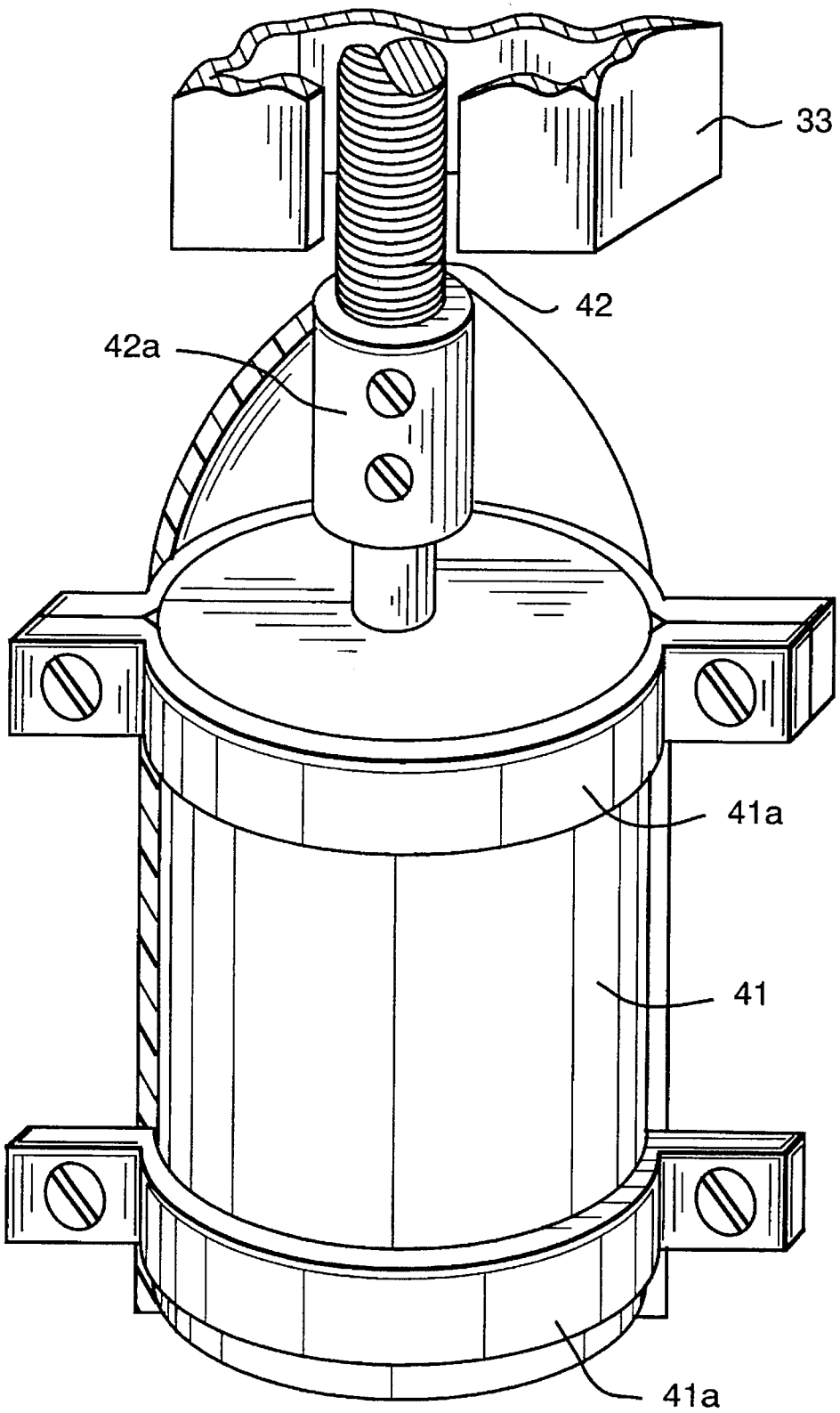

FIG. 10 is a front perspective view of the monitor elevator motor.

Figure 11:
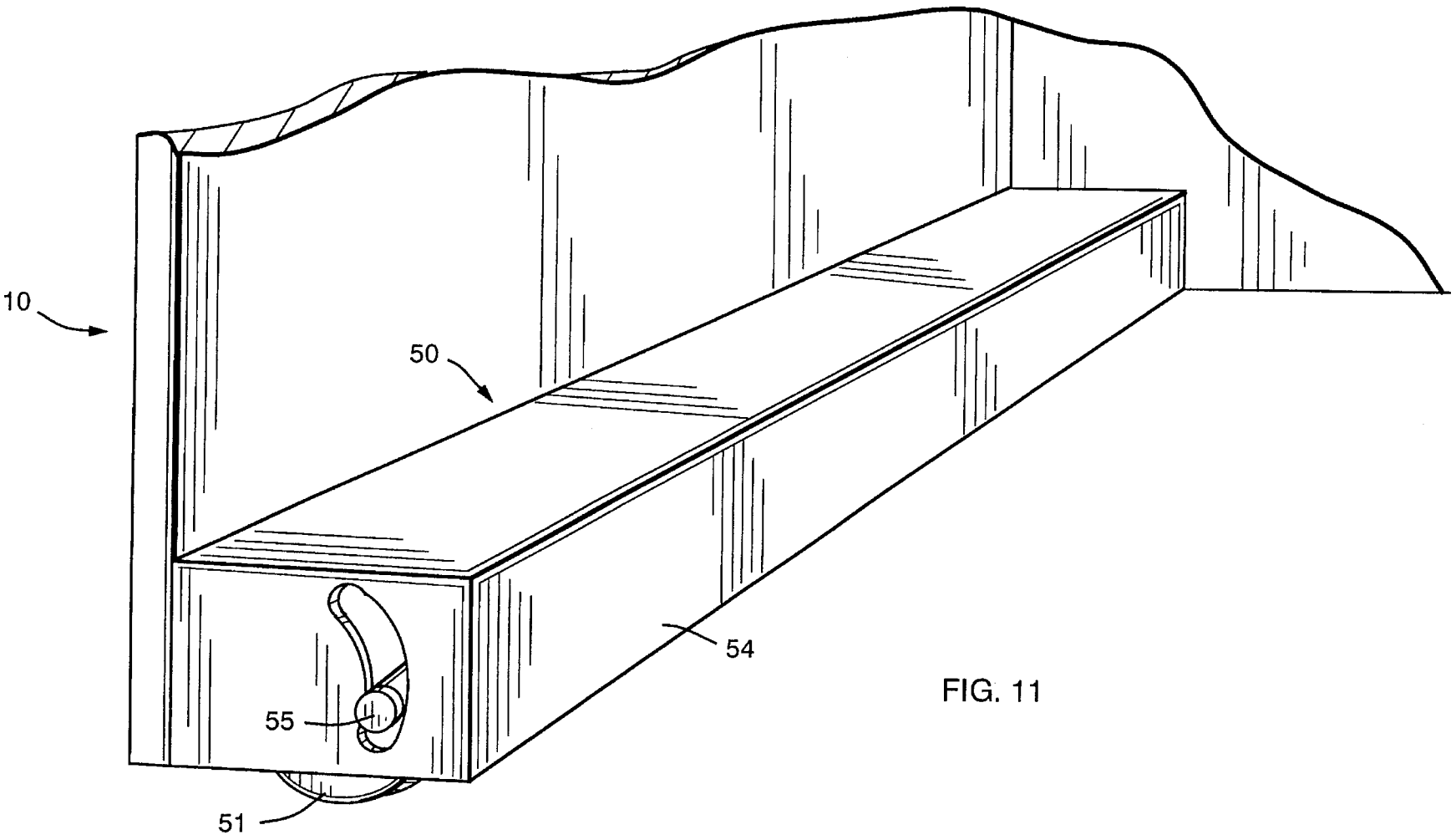

FIG. 11 is a front right perspective of a caster assembly box.

Figure 12:
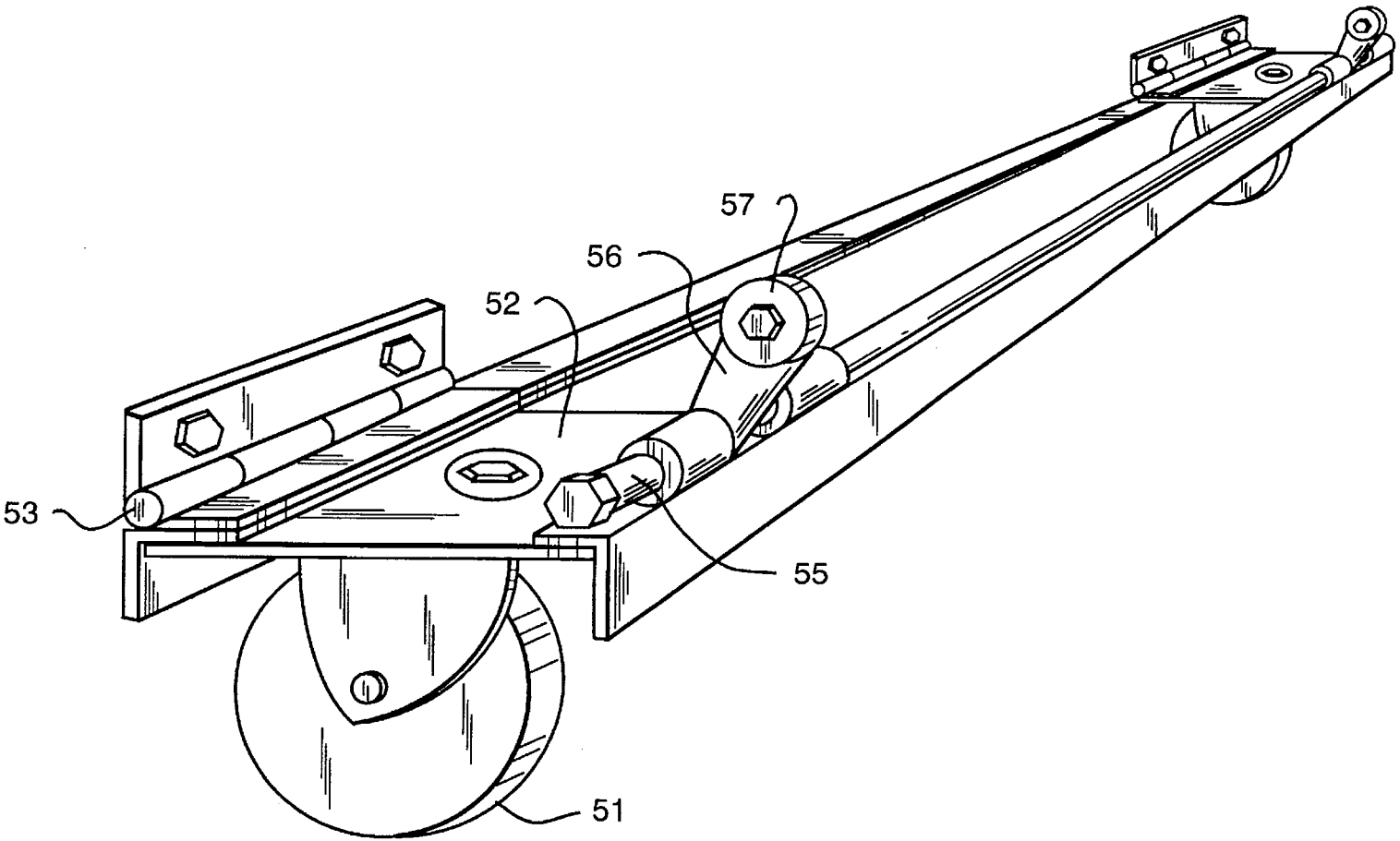
Figure 13:
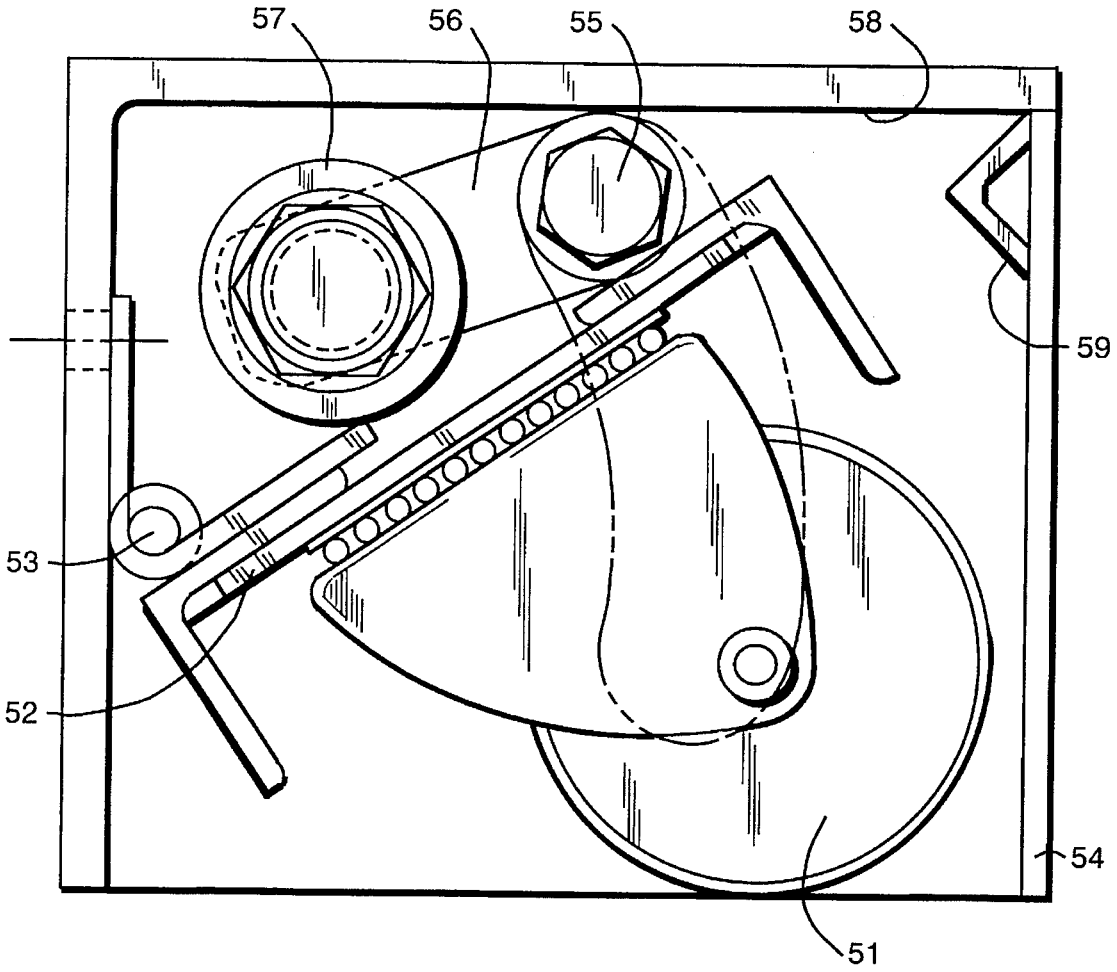

FIG. 12 is a front right perspective of the caster assembly mechanism.

FIG. 12 is a cross section end view of a caster assembly in the retracted position.

Figure 14:
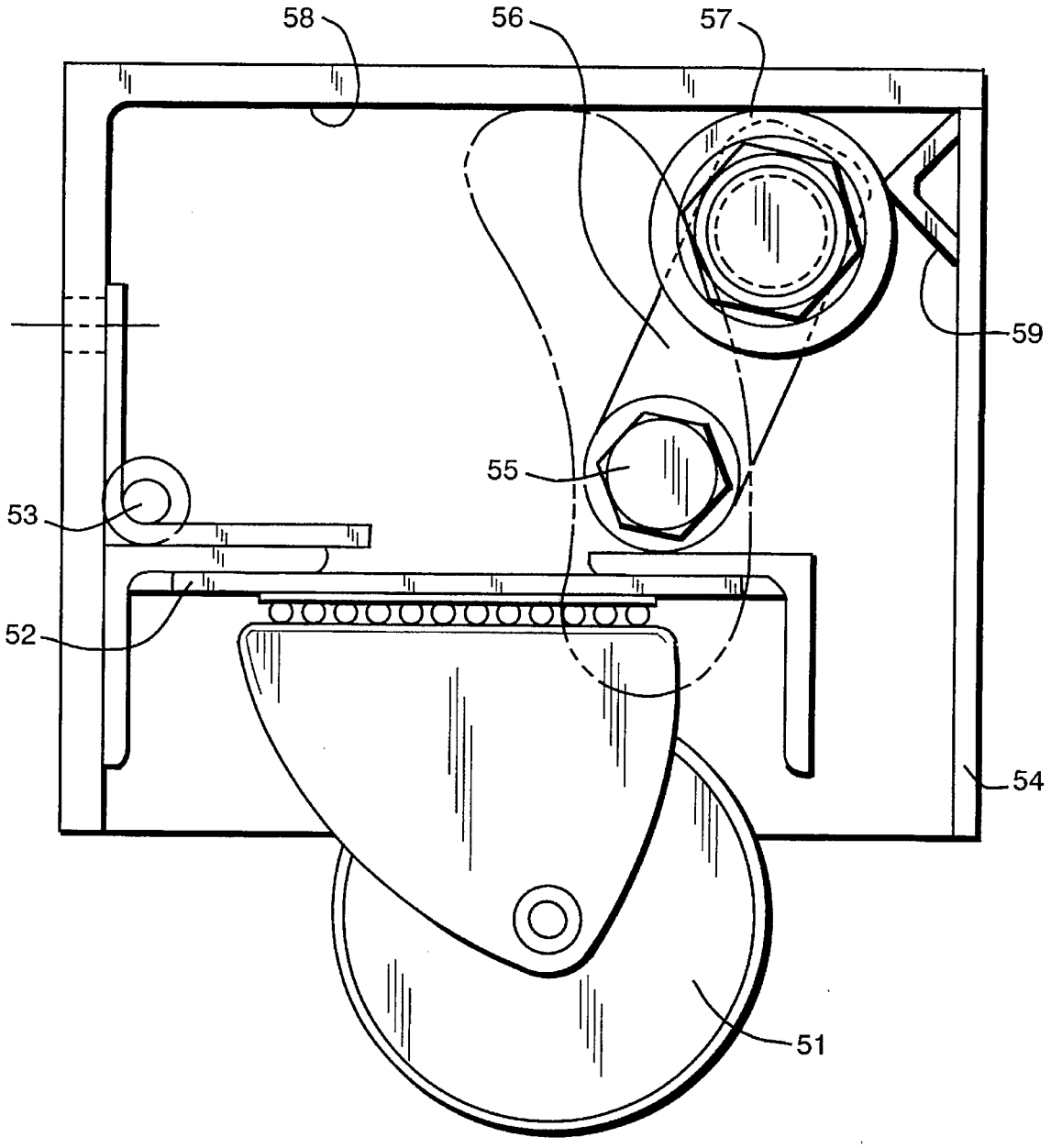

FIG. 14 is a cross section end view of a caster assembly in the extended position.

Figure 15:
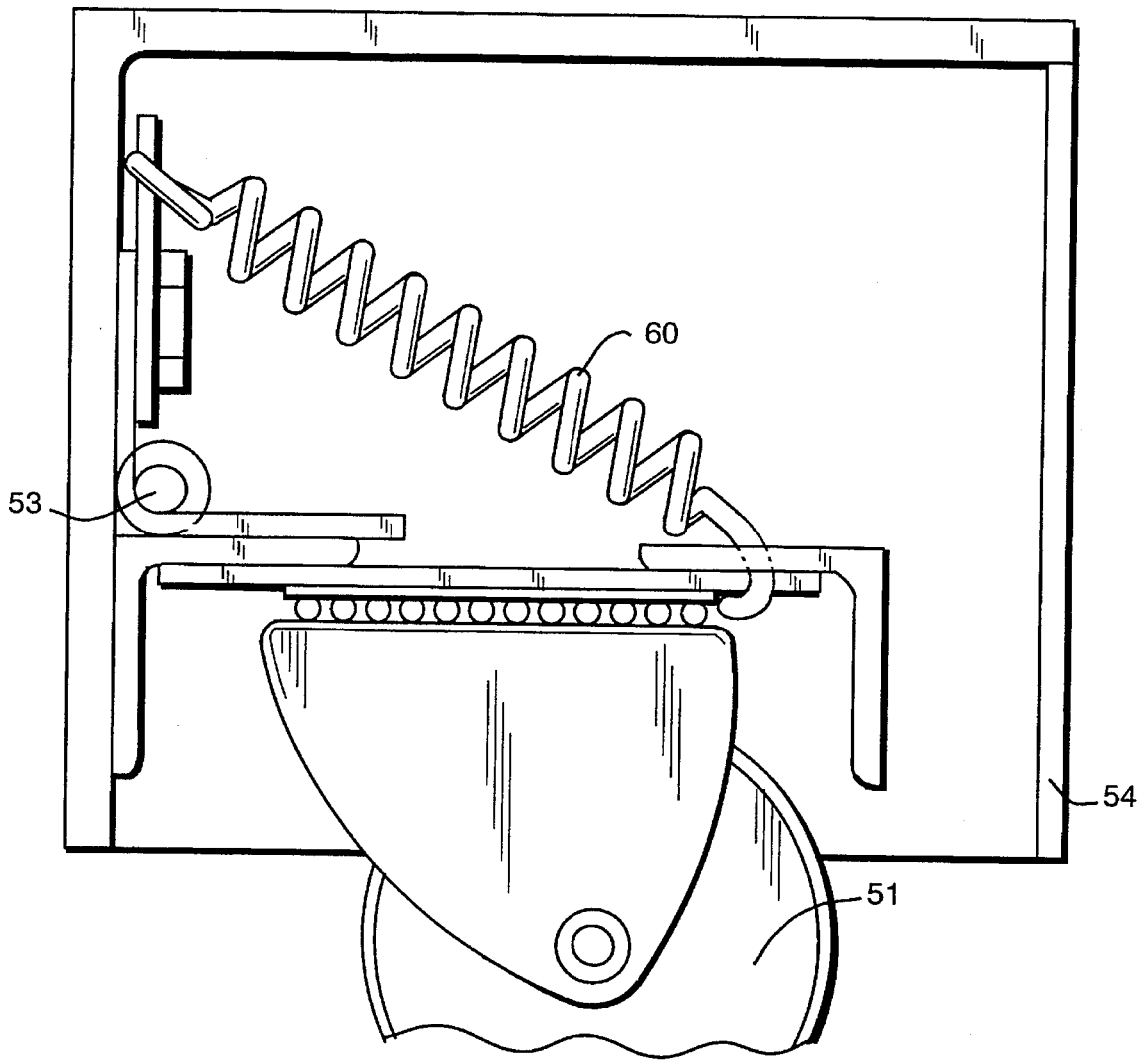

FIG. 15 is a cross section end view of a caster assembly mechanism showing a retainer spring.

DESCRIPTION OF THE PREFERRED EMBODIMENT

To those skilled in the art, the invention admits of many variations and combinations of known and novel features.

The transportable, fully-enclosable, office work station is normally prefabricated, and may be pre-wired with internal electric, video and telephone outlets and external connectors, equipped with equipment cooling and user ventilation system, speaker system, control panel and configured to accommodate the most common office automation tools, including phone, answering machine, fax/scanner, computer, printer and uninterruptable power supply.

The interior layout is ergonomically designed to optimize functionality, and incorporates or provides room for many common office accessories such as bulletin board, tape dispenser, file holder/sorter, mail holder, calendar, writing instruments and floppy disk storage. It is designed to attenuate outside noises, and provides bulk and file storage spaces and work surfaces with adjustable lighting.

When unlocked and opened up for use, the office can accommodate wheelchair users. When closed, the office has the appearance of a free-standing wardrobe, and protects the contents from sight and intrusion during off-hour, co-resident activities. There is room for a full-size, ergonomic office chair to be stowed within the closed office.

The office can be shipped to unconventional office sites, positioned where needed, connected to power and phone lines, equipped with office machines and be ready for use as a fully self-contained executive work center when desired, and securable during non-working hours, with little or no on-site preparation or alteration.

Novel features of the preferred embodiment of the invention include a powered monitor/CPU platform elevator. The computer elevator is specially positioned and configured to hold a computer monitor, and optionally a desktop or horizontal computer central processing unit (CPU), keyboard and mouse, at an infinitely-selectable working height within it's vertical range of motion in front of the user. It can be raised by a user control input to stow the monitor and CPU in a hidden, overhead position when not in use, in order to free desk area for other work tasks. It may hold and elevate a keyboard and mouse concurrently with the monitor and CPU.

The computer elevator may alternatively be connected to an adjustable force-balancing mechanism comprising, for example, a spring or counterweight connected by levers or cables and pulleys, to balance the weight on the computer elevator so that the user can easily move the elevator up to stow the computer when not in use.

When the office work station is to be configured with a CPU located other than under the monitor, such as a tower CPU, the elevator can accommodate the monitor only, and the CPU be positioned elsewhere in the cabinet.

Desktop height being just a little too high for comfortable keyboard use by many users, a vertically adjustable front section, the same size as a cutout in the base section of the desktop, provides means for adjusting keyboard height to suit the user and reverts to a closely fitting component of the desktop, with load bearing support means for strength and rigidity, to provide a full size desktop surface working area when the keyboard and computer are stowed.

The support means may, for example, be a lower layer of the base section of the desktop with a cutout that is slightly smaller or more shallow as measured from the front edge than the cutout in the upper layer and the front section, so that when the front section is vertically flush with the desktop and fully inserted into the upper layer cutout, it is firmly supported by the lip of the lower layer that projects into the upper layer cutout at the front corners and back edge.

Alternatively, fixed or adjustable support means such as fixed or rotatable or slidable brackets attached to the underside of the base section could be used to assure a smooth, stable desktop surface and provide stronger support for the front section than might normally be provided by the vertical adjustment mechanism which might, for example, be spring-loaded arms or ladder brackets attached to the underside of the base section of the desktop.

The base of the office work station enclosure cabinet is equipped with over-center, lift and roll, retractable caster assemblies, actuated by a quarter turn or so rotation of a shaft by means of a wrench or lever, which elevates the enclosure onto the casters to facilitate floor positioning or relocation. Once the enclosure is in proper position on the floor, the casters are retracted. A spring mechanism holds the caster assembly in the selected up or down position. Other types or variations of retractable wheel or caster assemblies could be used.

Reference is now made to the figures, which illustrate pictorially the various elements of the preferred embodiment of the invention.

Figure 1:
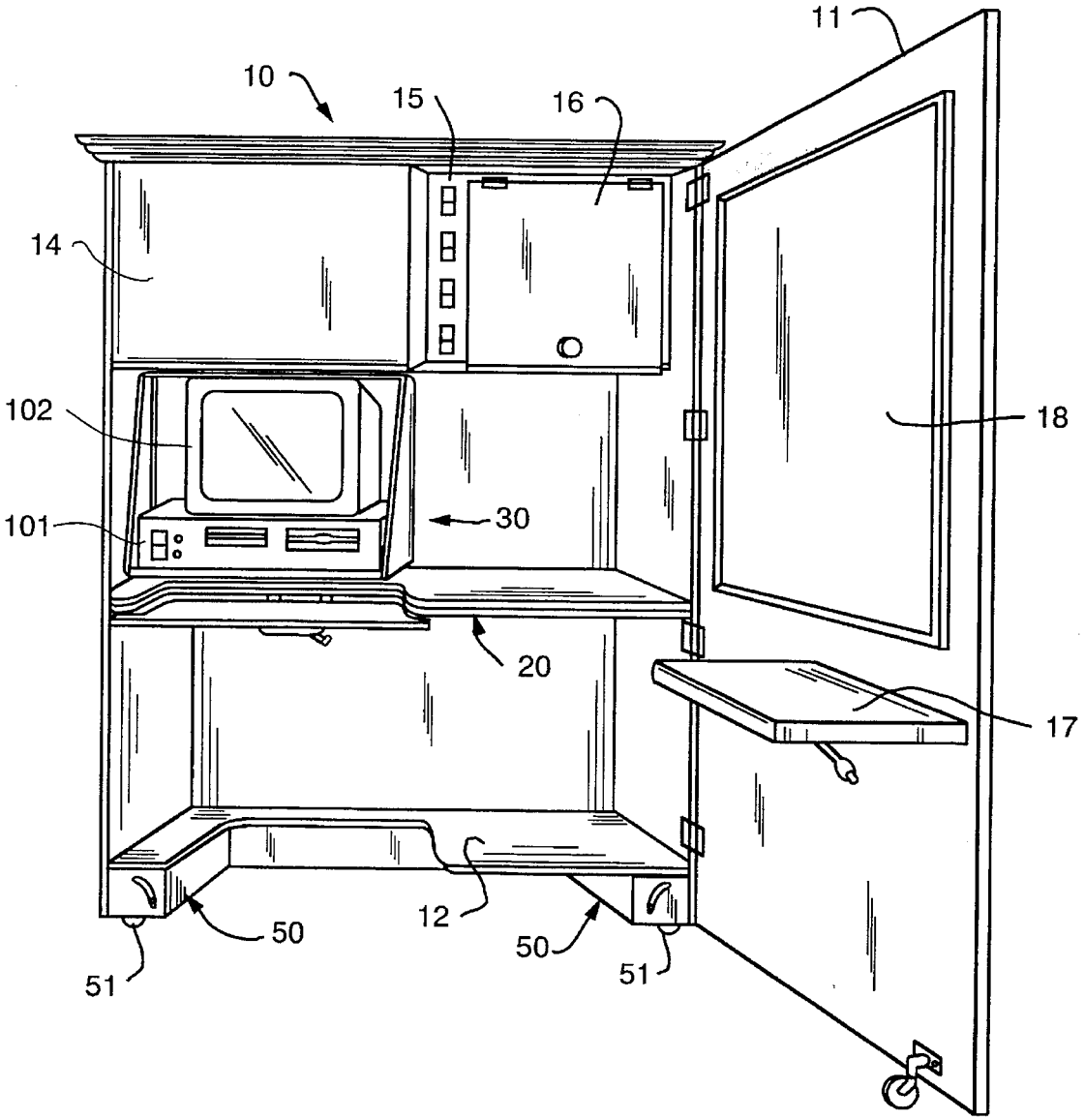
FIG. 1 is a front perspective of the transportable office work station with the door open.
Figure 2:
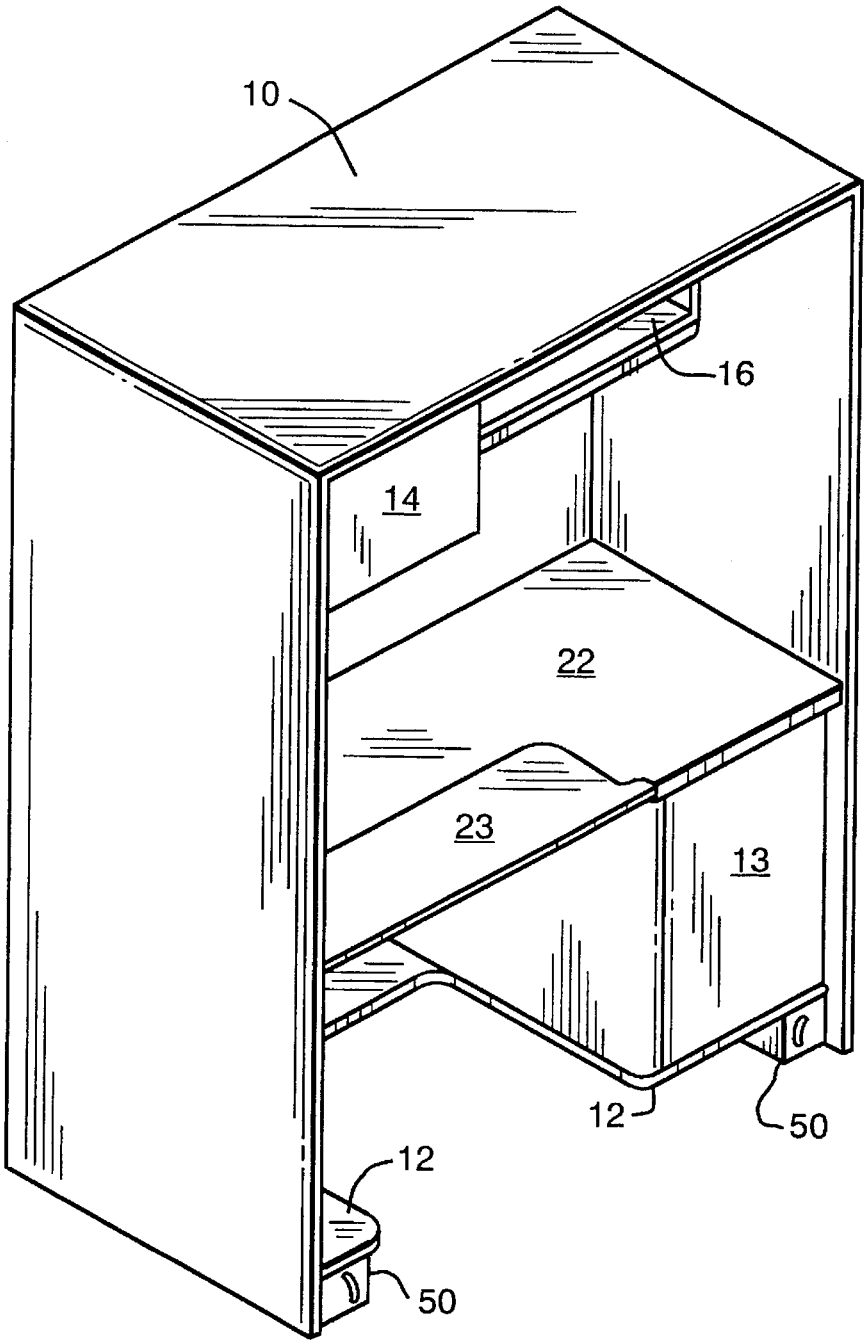
FIG. 2 is a left-front perspective of the cabinet minus door.

Referring to FIGS. 1 and 2, cabinet 10 has a door 11 which opens wide to expose the full interior. Door 11 is configured with folding shelf 17 and bulletin board 18. Cabinet 10 is reinforced near the bottom by cabinet former 12, and may be rolled on casters 51 when they are extended from caster assemblies 50.

Desktop 20, described in more detail below, provides intermediate level form support to cabinet 10, and functions alternatively as a full size working surface or a keyboard support. Overhead cabinet 16 provides storage space.

Computer elevator 30 supports computer processing unit CPU 101 and computer monitor 102 at user height, and may be raised to an overhead stowed position behind false front 14 by use of a switch on control panel 15. Underdesk cabinet 13 provides additional storage space.

Figure 3:
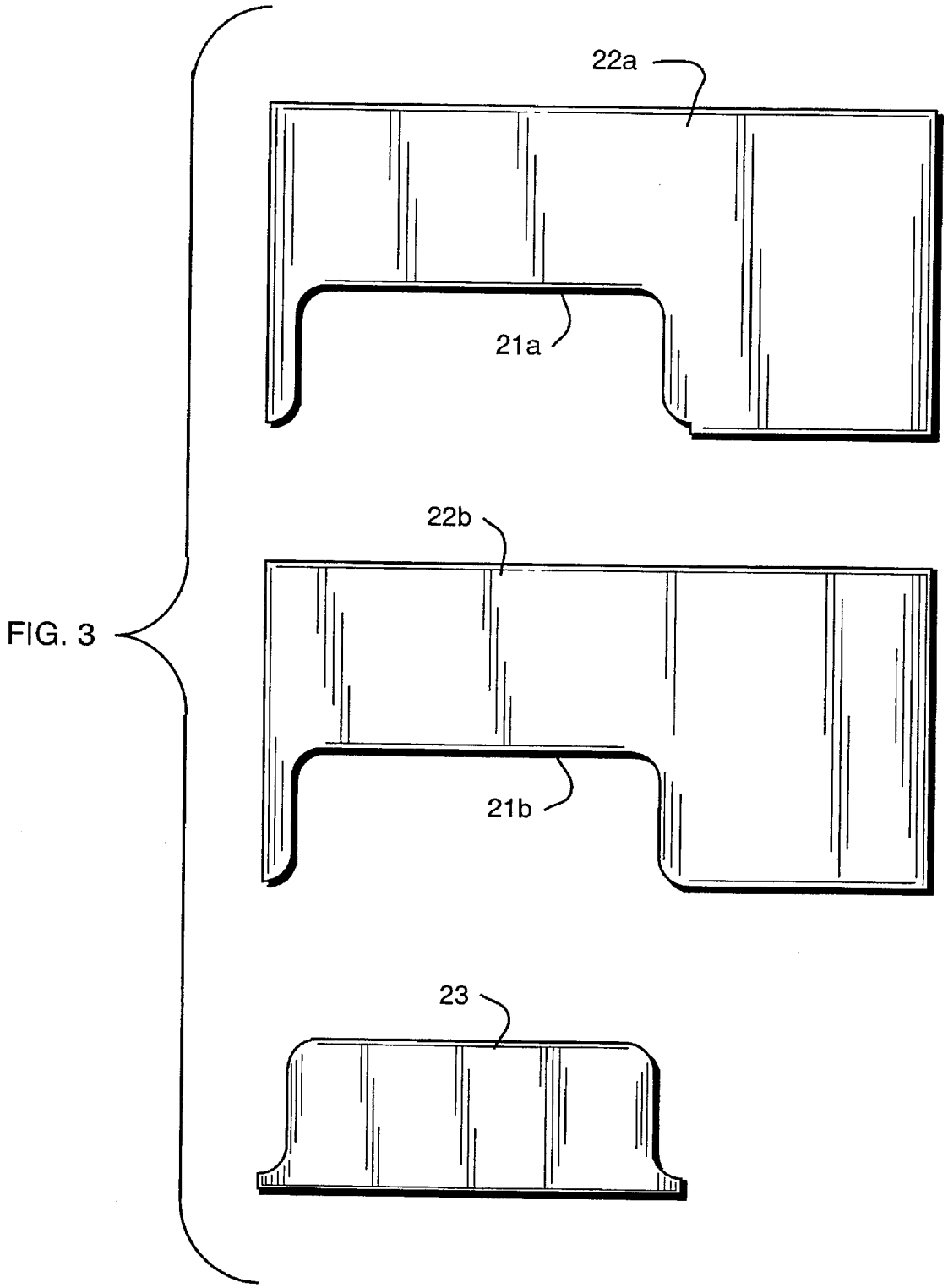
FIG. 3 is a plan view of the desktop sections and layers.
Figure 4:
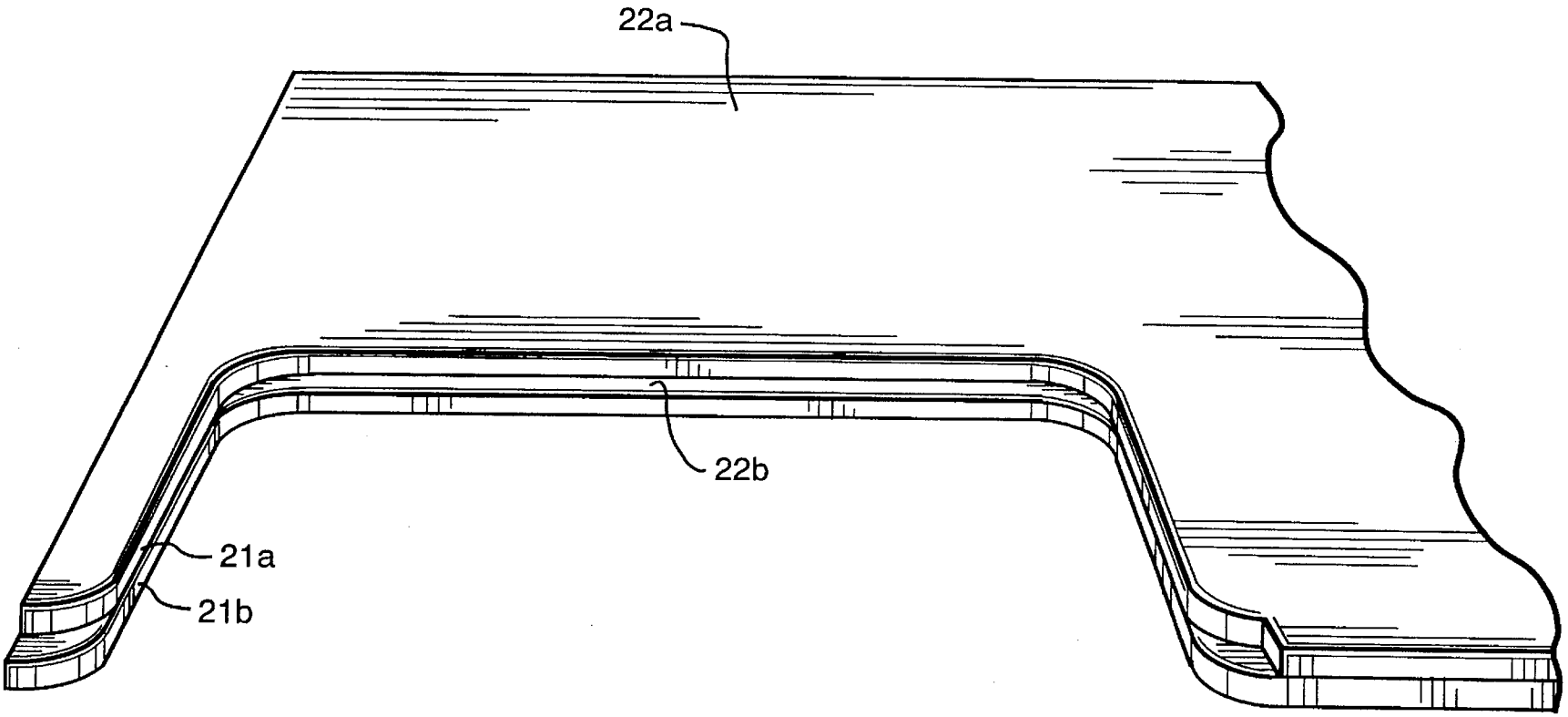

Referring to FIGS. 3 and 4, desktop 20 has three planar components: base section upper layer 22A with cutout 21A shown in its front edge, base section lower layer 22B with cutout 21B shown in its front edge, and front section 23, which conforms to the shape of cutout 21A in base section upper layer 22A.

Upper and lower layers 22A and B are laminated with respective cutouts being offset slightly to provide a load bearing support means for front section 23 when placed at desktop level.

Referring to FIG. 5, vertically adjustable attachment means 24 is fastened to the undersides of base section 22B and front section 23 to provide a normal range of vertical adjustment, in the order of four inches more or less, to front section 23 for use with a keyboard, and a small amount of lateral adjustment to enable front section 23 to be fully inserted into cutout 21 when level. Locking lever 24A secures front section 23 in the desired position.

Referring to FIG. 6, desktop 20 is shown with front section 23 in the level, load bearing position, providing a level, full size, wheelchair-accessible work surface when desired.

Referring to FIGS. 7, 8, 9 and 10, computer elevator platform 31 rides on tracks 33, which are secured to the interior walls of cabinet 10. Track rollers 32 are secured to sidewalls of computer elevator platform 31 to provide alignment with tracks 33 during vertical movement. Tracknuts 43 are secured to sidewall of platform 31 to transfer torque from screw 42 into lifting motion for platform 31. Motor 41 is coupled by shaft coupler 42A alternatively at the top or bottom end of screw 42, and is secured to an interior wall of cabinet 10 by mounting brackets 41A. Bearings at one or both ends of screw 42 bear the weight of platform 31.

Referring to FIGS. 11, 12, 13, 14 and 15, caster assembly 50 is comprised of casters 51 mounted on base plates 52 that are attached by hinges 53 to caster assembly box 54 and hence to sidewall of cabinet 10. Cam rollers 57 on respective cam brackets 56 are affixed to rotatable shaft 55, which is secured by means allowing rotation to base plates 52 on the side opposite hinges 53.

Rotation of shaft 55 in a clockwise direction as shown in the figures brings cam roller 57 into contact with bearing surface 58. Continued rotation in the clockwise direction extends casters 51, thereby raising cabinet 10 off the floor. Clockwise rotation is limited at a position slightly over center by cam stop 59. Reversing the rotation of shaft 55 retracts casters 51 in a corresponding fashion. Spring 60 retains casters 51 in either the extended or retracted position, however shaft 55 may be left.

In summary, the invention combines known and novel features, including a unique desktop/keyboard support design, computer elevator for overhead storage, and retractable caster system, into a unique transportable office work station that, when other features plus office equipment and accessories are added, creates a more versatile and efficient office work station than was previously known.

We claim:

1. A transportable office work station enclosure comprising:

a cabinet within which is configured a desktop and a computer elevator, and at least two retractable caster assemblies movable between a load-bearing extended position permitting rolling and a retracted position providing stationary positioning, said castor assemblies configured so as to permit said enclosure to set on the floor surface when in said retracted position and to lift and support said enclosure when moved from said retracted position into said extended position, each said caster assembly comprising a caster assembly box and at least two casters, each said caster mounted to a respective base plate, each said base plate attached by a hinge means to said caster assembly box and rotatable about said hinge means between said retracted and said extended positions, each said castor assembly further comprising a shaft rotatably attached to the side of each said base plate opposite said hinge means, said shaft being configured with a cam near each said castor such that rotation of said shaft forces each said cam up against a bearing surface of said caster assembly box and over center to a stop, moving each respective said caster downward against said floor surface into said extended position, thereby lifting and supporting said enclosure on said caster assemblies.

2. The work station enclosure of claim 1, each said caster assembly further comprising means for retaining said casters in last selected of said extended position and said retracted position, said means comprising a spring configured to maintain upward tension on said side of said base plate opposite said hinge means.

3. The work station enclosure of claim 1, said computer elevator comprising a platform suitable to hold at least a computer monitor, said platform being suspended over said desktop and having a vertical range of motion the upper limit of which is at least sixteen inches above said desktop.

4. The work station enclosure of claim 3, said platform further comprising means to hold a central processing unit and stow a keyboard and mouse.

5. The work station enclosure of claim 3, said computer elevator further comprising a force balancing mechanism adjustable so as to counter balance weight on said platform in order to facilitate manual operation thereof.

6. The work station enclosure of claim 3, said computer elevator comprising a powered means for operation and a user input for selecting desired vertical position.

7. The work station enclosure of claim 3, said computer elevator further comprising at least two track rollers attached to said platform, at least two tracks vertically attached to the interior walls of said enclosure, a least one track nut attached to said platform, and a vertically oriented screw rotatingly attached to said enclosure and confined within one said track, said screw engaged with said track nut such that rotation of said screw displaces said track nut and said platform in a vertical direction.

8. The work station enclosure of claim 1, said desktop further comprising a base section and a front section, said front section sized to hold at least a computer keyboard and attached by adjustable means to a said base section whereby said front section may be vertically adjusted within a normal range for support and use of a keyboard relative to height of said base section, said base section further comprising at least an upper layer and a lower layer, said upper layer having a cutout closely conforming to the shape of said front section, said lower layer extending partially under and providing direct support to said front section when said front section is vertically aligned with said upper layer and inserted into said cutout.

9. The work station enclosure of claim 11, said cabinet further comprising external connectors pre-wired to internal telephone and electrical outlets.

10. A retractable caster assembly movable between an extended position permitting rolling and a retracted position providing stationary positioning, said caster assembly comprising a caster assembly box and at least two casters, each said caster mounted to a respective base plate, each said base plate attached by a hinge means to said caster assembly box and rotatable about said hinge means between said retracted and said extended positions, said castor assembly further comprising a shaft rotatably attached to the side of each said base plate opposite said hinge means, said shaft being configured with a cam near each said castor such that rotation of said shaft forces each said cam up against a bearing surface of said caster assembly box and over center to a stop, moving each respective said caster downward against said floor surface into said extended position, thereby lifting and supporting said caster assembly.

* * * * *